US006672113B2

(12) United States Patent
Okamoto

(10) Patent No.: US 6,672,113 B2
(45) Date of Patent: Jan. 6, 2004

(54) METHOD OF KNITTING NECK OF KNIT WEAR BY WEFT KNITTING MACHINE AND KNIT DESIGNING DEVICE FOR PRODUCING THE METHOD OF KNITTING THE NECK

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/169,903

(22) PCT Filed: Jan. 24, 2001

(86) PCT No.: PCT/JP01/00490

§ 371 (c)(1),
(2), (4) Date: Jul. 11, 2002

(87) PCT Pub. No.: WO01/55492

PCT Pub. Date: Aug. 2, 2001

(65) Prior Publication Data

US 2003/0000261 A1 Jan. 2, 2003

(30) Foreign Application Priority Data

Jan. 26, 2000 (JP) ..... 2000-017005

(51) Int. Cl.[7] ..... D04B 7/10
(52) U.S. Cl. ..... 66/76; 66/172 R
(58) Field of Search ..... 66/76, 64, 69, 66/70, 169 R, 170, 171, 176, 172 R

(56) References Cited

U.S. PATENT DOCUMENTS 5,417,088 A * 5/1995 Nakai ..... 66/76
5,584,197 A * 12/1996 Okuno ..... 66/64
5,956,975 A * 9/1999 Kawashima ..... 66/64
6,079,232 A * 6/2000 Yui ..... 66/70

FOREIGN PATENT DOCUMENTS

| | | |
|---|---|---|
| JP | 4-214448 A | 8/1992 |
| JP | 8-158209 A | 6/1996 |
| JP | 10-77556 A | 3/1998 |
| JP | 11-315449 A | 11/1999 |

* cited by examiner

*Primary Examiner*—Danny Worrell
(74) *Attorney, Agent, or Firm*—Rothwell, Figg, Ernst & Manbeck, P.C.

(57) ABSTRACT

In order to seamlessly knit knitwear, such as a sweater, having a widened neckline 10*a* of a front body 2*a* and a front drop formed in the neckline 10*a* in a relatively simple method, stitches at a right side of the front neckline 10*a* and stitches at a left side of the front neckline 10*a,* retained on the first needle bed FB, are shifted from inside to outside, with gradually increasing distances, so that the stitches can be retained on the first needle bed FB, with empty needles inserted in the spaces between those stitches; at least one of the shifted stitches 31, 32 at and outer side end portion of the right side of the front neckline 10*a* and at least one of the shifted stitches at an outer side end portion of the left side of the front neckline 10*a* are fed to the second needle bed BB so as to be situated next to the stitch at each side end of the back neckline 10*b* retained on the second needle bed BB, whereby the neckline 10 is increased in diameter, followed by formation of widening stitches on the empty needles and then knitting of a collar 8.

5 Claims, 6 Drawing Sheets

METHOD OF KNITTING NECK OF KNIT WEAR BY WEFT KNITTING MACHINE AND KNIT DESIGNING DEVICE FOR PRODUCING THE METHOD OF KNITTING THE NECK

TECHNICAL FIELD

The present invention relates to a knitting method of knitting a collar of knitwear, such as a vest and a sweater, by using a flat knitting machine and to a knit design system for producing a collar knitting command.

BACKGROUND ART

The applicant previously proposed in Japanese Laid-open (Unexamined) Patent Publication No. Hei 4(1992)-21448 a knitting method of knitting a knitted fabric by using a flat knitting machine wherein a neckline of a front body is widened and also a front drop is formed in the neckline. In this knitting method, the front body is so knitted as to be forked from a starting point for forming the neckline into a right front body and a left front body which confront each other across the neckline. In the process of the knitting, widening stitches are formed around a margin of the neckline and also the stitches of the right front body and left front body are shifted to the outside, respectively. This knitting is repeated to knit the front body to the shoulder. As a result of the neckline being formed in this manner, the number of wale of the neckline is increased and, as a result of this, not only a collar knitted subsequent thereto is widened but also the front drop is automatically formed in the neckline. When the front body thus knitted is used to produce a sweater, the knitwear comes to be fancy and stylish and so comfortable to wear that when wearing, one's head can smoothly pass through the neckline.

The method of the publication cited above discloses a knitting technology for knitting the front body singularly as a part, rather than the so-called "seamless knit" that is the knitting technology in which the front body and the back body are joined at each knitting-widthwise end, to knit them into a tubular form and also are joined to each other at their shoulder portions in the process of knitting by using the flat knitting machine, whereby knitwear, such as a vest and a sweater, is completed.

The "seamless knit" is the knitting technology for simplifying or omitting the sewing operation after the knitting process. The applicant has proposed in many applications a variety of knitting technologies on and in connection with the seamless knit so far, including Japanese Laid-open (Unexamined) Patent Publications No. Hei 2(1990)-91254, Hei 2(1990)-229248, Hei 4(1992)-209855 and Hei 4(1992)-153346.

In the seamless knit using a two-bed flat knitting machine, for examples, odd needles on the needle beds are used for a front part of a knitted fabric, such as a front body and front sleeve parts; even needles are used for a back part of the knitted fabric; and alternate needles on the front and back needle beds are used for the seamless knit. When the front part of the knitted fabric is knitted, the back part of the knitted fabric is retained on (associated with) the back needle bed. On the other hand, when the back part of the knitted fabric is knitted, the front part of the knitted fabric is associated with the front needle bed. Thus, the respective fabrics are knitted, with the front and back parts overlapping each other. As a result of this, the empty needles used for transference of stitch can always be reserved for the respective parts of the knitted fabric on the opposed needle beds. Using those empty needles enables the knitting of the structure pattern, such as links, garter and rib, in which front stitches and back stitches are mixed, and also enables the stitches of the sleeves and bodies to be shifted laterally so as to be joined to each other. In contrast to this, in the seamless knit using a four-bed flat knitting machine, for example, the needles on the lower front needle bed and the upper back needle bed are used to knit the front part of the knitted fabric, and the needles on the lower back needle bed and the needles on the upper front needle bed are used to knit the back part of the knitted fabric. In the seamless knit using the four-bed flat knitting machine, when the front part of the knitted fabric is knitted, the back part of the knitted fabric is associated with the lower back needle bed. On the other hand, when the back part of the knitted fabric is knitted, the front part of the knitted fabric is associated with the lower front needle bed. As a result of this, the seamless knit using the four-bed flat knitting machine does not have the limitation that the alternate needles are used for the seamless knit, as in the seamless knit using the two-bed flat knitting machine. The seamless knit can be made by using a flat knitting machine of a transfer jack bed type wherein transfer jacks are arranged in line over either or both of the front and back needle beds of the two-bed flat knitting machine.

On the other hand, the stitch loop holding technique disclosed by Japanese Laid-open (Unexamined) Patent Publication No. Hei 11(1999)-43849, which is called "holding technique", is applicable to the seamless knit. The terminology, "holding", means the stitch loop holding technique using a kind of compound needle, which is called "slide needle", comprising a needle body and a slider which is formed by combining two thin metal sheets and has a tongue at a front end portion thereof. In the holding technique, the stitch as was originally retained on the hook of the needle body is held on the needle and also an additional stitch is received and held on the tongue of the slider, so that those two different stitches are separately held on the same needle. Reference is made to the publication mentioned above about the details of "the holding". Using this holding technique enables the needle from which the stitch is transferred to be used as the empty needle. If this holding technique is used to transfer the stitches back to the original empty needles after the knitting is adequately performed, even the two-bed flat knitting machine can knit the knitwear seamlessly with all needles, without any need for previous reservation of the empty needle for the transference of stitch.

However, the application of the knitting method of Japanese Laid-open (Unexamined) Patent Publication No. Hei 4(1992)-21448 previously cited to the knitwear to be knitted seamlessly is not easy when the knitwear is wanted to widen the collar width and also form the front drop in the neckline. For example, when the knitwear is knitted in the form of a vest, consideration must be taken of not only the front body but also the relation with the back body which is integrally knitted in parallel with the front body to confront it. Further, in knitting a sweater, a cardigan or the like, since the sleeves are laid at each side of the bodies, further consideration must be taken, including the horizontal and vertical positions of those parts and the way of forming the neckline in the front body and of being integrally knitted with the other parts while shifting the neckline to the outside, thus requiring further complicated consideration and calculation.

It is the object of the present invention to provide a knitting method wherein knitwear, such as sweater, having a widened neckline formed in its front body and having a front drop formed in the neckline is seamlessly knitted in a relatively simply way and to provide a knit design system storing therein a knitting method of knitting the neckline.

DISCLOSURE OF THE INVENTION

The present invention provides a method of knitting knitwear, such as a vest and a sweater, comprising a front part of fabric having at least a front body and a back part of fabric having at least a back body by using a flat knitting machine comprising at least a pair of front and back needle beds, which are extended laterally and confront each other in back and front and at least either of which can be racked laterally to transfer stitches between the needles beds. The method comprises the step that the front part of fabric and the back part of fabric are knitted from their bottom hems to shoulders in the condition that the front part of the fabric is associated with the first needle bed and the back part of the fabric is associated with the second needle bed, so that the front part of the fabric and the back part of the fabric are joined at both knitting-widthwise ends, so as to be knitted in the form of a tubular body; the step that during this process, the front body is knitted to be forked into a right front body and a left front body from a front neckline forming portion and also a flechage knitting that the stitches around a margin of the front neckline are sequentially slipped from the knitting to be put into inoperative positions is repeated a predetermined number of times, so as to form the neckline having a front drop in the front body; and the step that the front part of the fabric and the back part of the fabric are joined to each other at the shoulders, except the necklines, so that the knitwear is knitted into a seamless knit. The method of the invention further comprises the step that stitches at a right side of the front neckline and stitches at a left side of the front neckline, retained on the first needle bed, are shifted from inside to outside, with gradually increasing distances, so that those stitches can be retained on the first needle bed, with empty needles inserted in the spaces between the stitches; the step that at least one of the shifted stitches at an outer side end portion of the right side of the front neckline and at least one of the shifted stitches at an outer side end portion of the left side of the front neckline are fed to the second needle bed so as to be situated next to the stitch at each side end of the back neckline retained on the second needle bed, whereby the stitches at each side end of each of the necklines retained on the front and back needle beds are kept in the positions close to each other, without being away from each other in a lateral direction to a large extent, in the condition of which the neckline is increased in diameter, followed by formation of widening stitches on the empty needles and then knitting of a collar.

It is preferable that when there are a plurality of stitches to be fed to the second needle bed at the outer side end of the right side of the front neckline and at the outer side end portion of the left side of the front neckline, respectively, the plurality of stitches are sequentially fed to the second needle bed from the stitch situated at the side end of the front neckline.

Also, the present invention provides a knit design system for producing a knitting process of a collar by using a flat knitting machine comprising at least a pair of front and back needle beds, which are extended laterally and confront each other in back and front and at least either of which can be racked laterally to transfer stitches between the needles beds, and a built-in computer. The knit design system comprises means for producing the following commands:

a: the command that stitches at a right side of a front neckline and stitches at a left side of the front neckline, retained on the first needle bed, are shifted from inside to outside, with gradually increasing distances, in such a sequence as to be first shifted a stitch and then shifted two stitches, so that those stitches can be retained on the first needle bed, with empty needles inserted in the spaces between the stitches, and also at least one of the shifted stitches at an outer side end portion of the right side of the front neckline and at least one of the shifted stitches at an outer side end portion of the left side of the front neckline are fed to the second needle bed so as to be situated next to the stitch at each side end of a back neckline retained on the second needle bed;

b: the command that subsequent to the knitting process mentioned above, widening stitches are formed on the empty needles; and c: the command that subsequently, a collar is knitted.

Now, operation of the present invention will be described. When knitwear such as a vest and a sweater is knitted seamlessly, a flechage knitting that the front body is knitted to be forked into the right front body and the left front body from a front neckline forming portion and also the stitches around the margin of the neckline are sequentially slipped from the knitting to be put into inoperative positions is repeated a predetermined number of times. As a result of this, the number of courses around the neckline is gradually decreased toward the shoulder to form the neckline into a circular form and the front drop is formed in the front body. Thereafter, the front part of the fabric and the back part of the fabric are joined to each other at the shoulders, except the necklines. The knitting steps before the knitting steps of the collar are ended in this manner.

After that, in advance of the knitting of the collar which is to be knitted in continuation with the remaining stitches of the neckline on the needle beds, the process of widening the knitting width of the front neckline is started. The stitches at the right side of the front neckline retained on the first needle bed are shifted from inside to outside, with gradually increasing distances, in such a sequence as to be first shifted a stitch and then shifted two stitches, and empty needles are inserted in the spaces between the stitches. The same knitting is applied to the stitches at the left side of the front neckline. The shift of the stitch is afforded by using the transference of stitch and the racking of needle bed. In the two-bed flat knitting machine that works to knit with alternate needles, the empty needles used for the transference of stitch are reserved for the knitting on the opposed needle beds, so that the stitch is shifted at the distance twice as far as the distance in the knitting using every needle. In the flat knitting machine having the transfer jack, the shift of stitch may be afforded by use of the transfer jack. At least one of the shifted stitches at each side end portion of the front neckline is fed to the second needle bed to be situated adjacent to the stitch at the side end of the back neckline retained on the second needle bed. When the knitting width of the front neckline is increased two wale in each side thereof, the stitches located one at each end of the front neckline are fed to the second needle bed. When the knitting width of the front neckline is increased four wale in each side thereof, the stitches located two at each end of the front neckline are fed to the second needle bed. When the knitting width of the front neckline is increased six wale in each side thereof, the stitches located three at each end of the front neckline are fed to the second needle bed. Thus, in response to increase in the knitting width to be increased, the number of stitches to be fed to the second needle bed increases. When there are two or more stitches to be fed to the second needle bed, those stitches are sequentially fed from the one located at each end of the front neckline.

Thus, the stitches at each side end of each of the necklines retained on the needle beds are kept in the positions close to each other, without being away from each other in a lateral direction to a large extent, and in this condition, the neckline is increased in diameter. Then, after the neckline is widened in this manner, widening stitches are formed on the empty needles inserted in the spaces between the stitches, to set up the knitting of the collar.

Since the knitting process for widening the neckline is started after the front part of the fabric and the back part of the fabric are joined at the shoulders, the issue that consideration must be taken of the horizontal and vertical positions of the parts of the fabric, such as the bodies and the sleeves, on the needle beds, as well as of the way how those parts are integrally knitted, while forming the neckline in the front body, can be ignored. As a result of this, the knitwear of stylish and so comfortable to wear that when wearing, one's head can smoothly pass through the neckline can be produced in a relatively simple manner.

BEST MODE FOR CARRYING OUT THE INVENTION

In the following, a certain preferred embodiment of the present invention will be described in detail with reference to the accompanying drawings.

In the illustrated embodiment, a flat knitting machine is used which comprises a front needle bed (FB) and a back needle bed (BB), which have thereon a number of slide needles arranged in line and are arranged to confront each other in front and back, with the back needle bed arranged to be racked laterally, and between which stitch is transferred, and a transfer jack bed (TJB) which is arranged over the front needle bed in such a manner as to be racked laterally and has thereon a number of transfer jacks arranged in line, so as to transfer stitch between the transfer jack and the front and back needle beds is used, though not shown.

Figure 1:
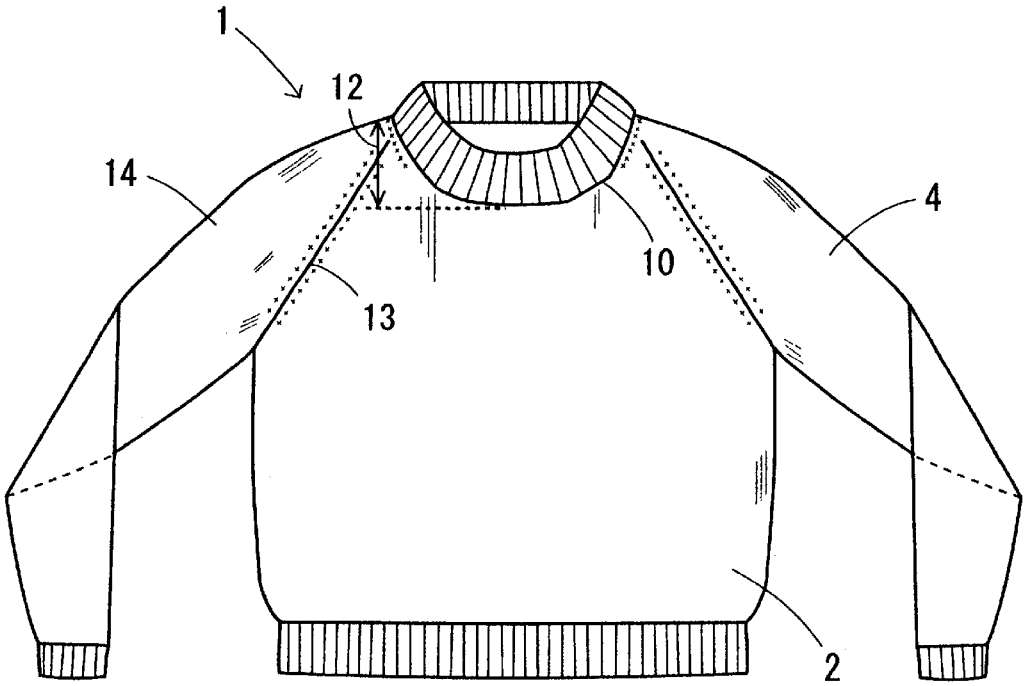
FIG. 1 shows a sweater knitted in the embodiment of the present invention.
Figure 2:
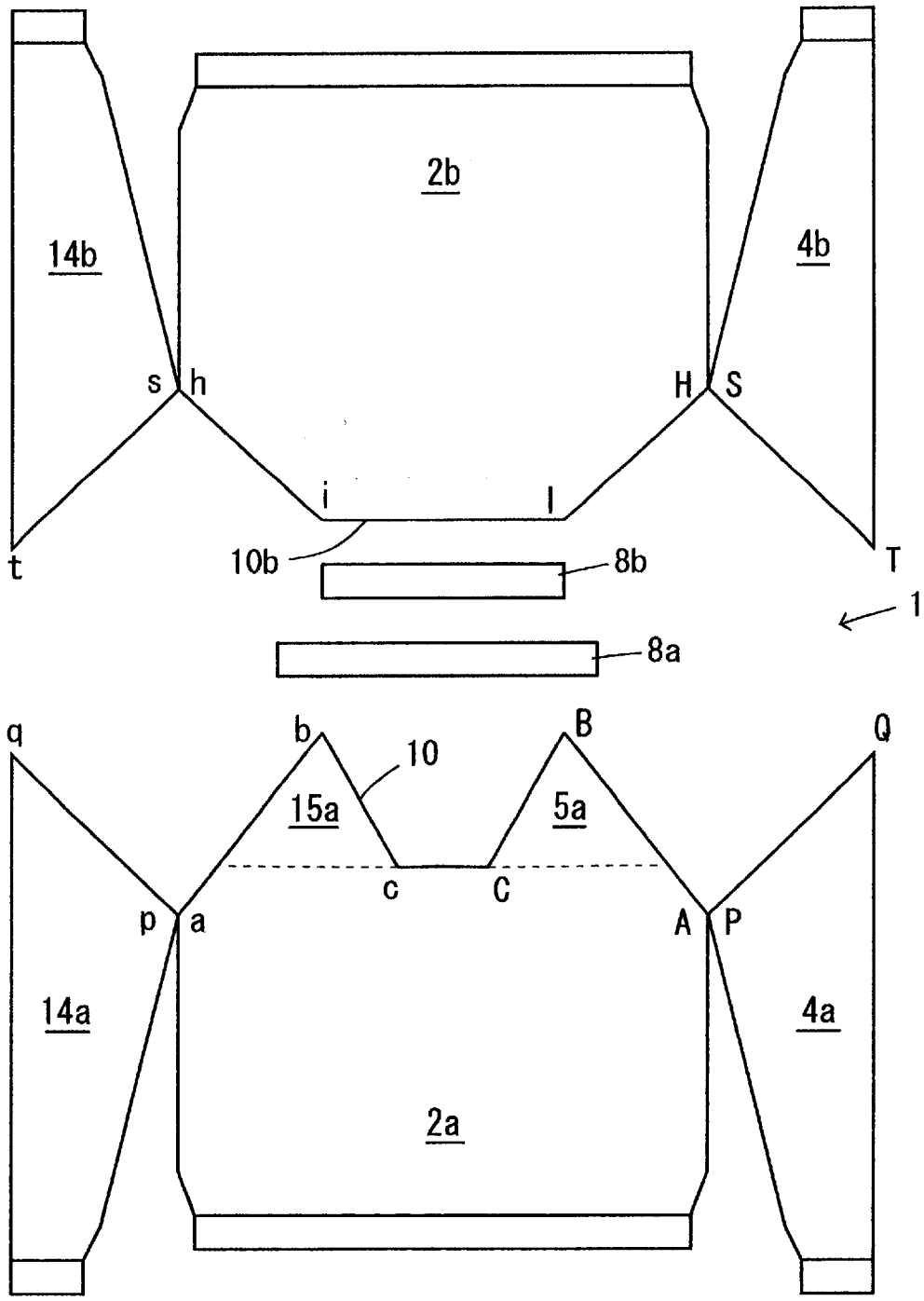
FIG. 2 shows parts of the sweater of the embodiment that are to be knitted on a flat knitting machine.

FIG. 1 shows a sweater 1 knitted as knitwear in this embodiment. The sweater 1 has a raglan type of sleeves 4, 14 and a rounded-neck. For convenience of explanation, the sweater is designed to have the knitting structure of an unpatterned plain knit, though it may have a structure pattern such as jacquard or rib. FIG. 2 shows a pattern paper (stitch alignment) of bodies 2, sleeves 4, 14 and a collar 8 of the sweater 1. Illustrated above are back parts of the sweater, including a back body 2*b*, back sleeves 4*b*, 14*b*, and a back collar 8*b*, which will appear at the back side when a wearer wears the sweater. These back parts of the sweater are knitted with the needles on the back needle bed. Illustrated below are front parts of the sweater, including a front body 2*a*, front sleeves 4*a*, 14*a*, and a front collar 8*a*, which will appear at the front side when the wearer wears the sweater. These front parts of the sweater are knitted with the needles on the front needle bed, except a part of an outer part of the front collar, as will be mentioned later.

In the sweater 1, the front body 2*a* and the front sleeves 4*a*, 14*a* are joined at the underarms A, a and P, p of the front body and the front sleeves, and the back body 2*b* and the back sleeves 4*b*, 14*b* are joined at the underarms H, h and S, s of the back body and the back sleeves. The line A–B of the front body 2*a* and the line P–Q of the sleeve 4*a* are joined, and the line a–b of the front body 2*a* and the line p–q of the sleeve 14*a* are joined. Likewise, the line H–I of the back body 2*b* and the line S–T of the sleeve 4*b* are joined, and the line h–i of the back body 2*b* and the line s–t of the sleeve 14*b* are joined. The front body 2*a* is different from the back body 2*b* in the shape subsequent to the points C, c of the neckline 10*a* and is knitted to be forked into a right front body 15*a* and a left front body 5*b*. It is to be noted that the terms "right" and "left" appearing in the members, such as the right front body and the left sleeve, is intended to mean the right-hand part and the left-hand part when viewing from the a wearer who wears the sweater. 8*a* designates a front collar which is larger in knitting width than a back collar 8*b*.

Figure 3:
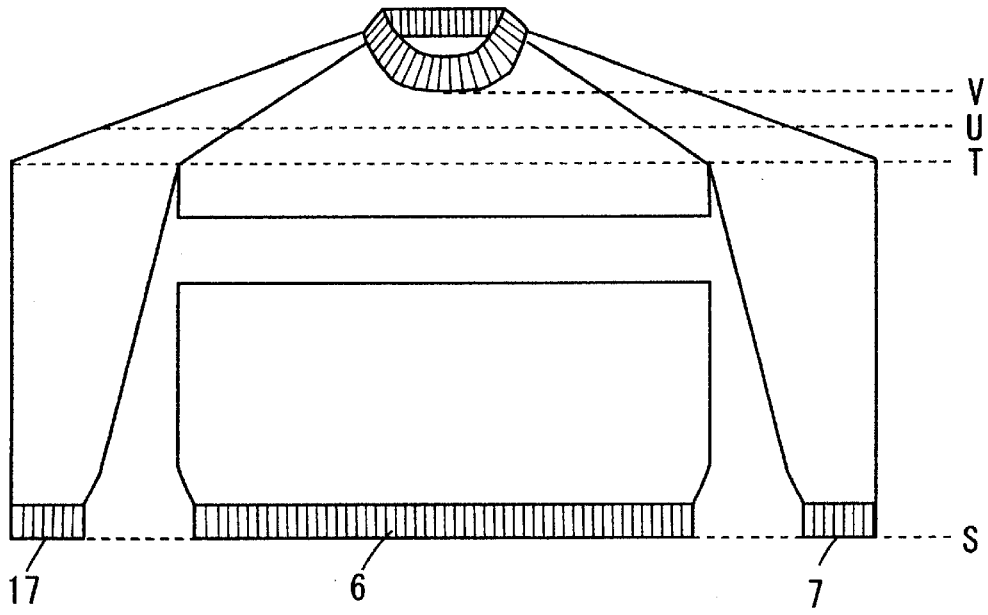
FIG. 3 schematically shows each stage of the knitting of the sweater of the embodiment.

FIG. 3 schematically shows each stage of the knitting of the sweater. In the step S, after yarns are fed to needles of the front needle bed by yarn feeders (not shown) prepared for the body 2 and the sleeves 4, 14, respectively, the yarn feeders are reversed in direction to feed the yarns to needles of the back needle bed. This knitting is repeated to start knitting rib portions 6, 7, 17 of a tubular body. In the step T, the sleeves 4, 14 are knitted up to the underarms (at A, P, a, p, S, H, s, h) in parallel with the knitting of the body 2, while increasing the diameters of the sleeves 4, 14.

In the steps T–U, the body 2 and the sleeves 4, 14 are knitted and united into a single tubular body by using the same yarn feeders that have been used, for example, for the knitting of the body. Whenever the body and the sleeves are knitted, they are overlaid with each other along the joining line 13 to gradually reduce the diameter of the tubular body. From the step V, the front body 2*a* is forked into the right front body 15*a* and the left front body 5*a* and formation of a neckline 10*a* is started. In this step, the fabric is knitted in the order of the right front body 15*a*, the right sleeve 14, the back body 2*b*, the left sleeve 4 and the left front body 5*a*, first. Then, the yarn feeders are reversed in direction at the neckline 10*a*, so that the knitting proceeds in the inverse order of the left front body 5*a*, the left sleeve 4, the back body 2*b*, the right sleeve 14 and the right front body 15*a*. The yarns are fed shuttlewise as if the alphabetic character "C" is drawn, so that the bodies and the sleeves are joined along the lines A–B, H–I, a–b and h–I, while knitting up to the shoulder. During this knitting, the flechage knitting that the stitches around the margin of the neckline 10*a* are sequentially put into inoperative positions along the lines C–B and c–b is made, so that when the sweater 1 is completed, a front drop (12 of FIG. 1) like a circularly cut front neckline 10*a* is formed.

Figure 4:
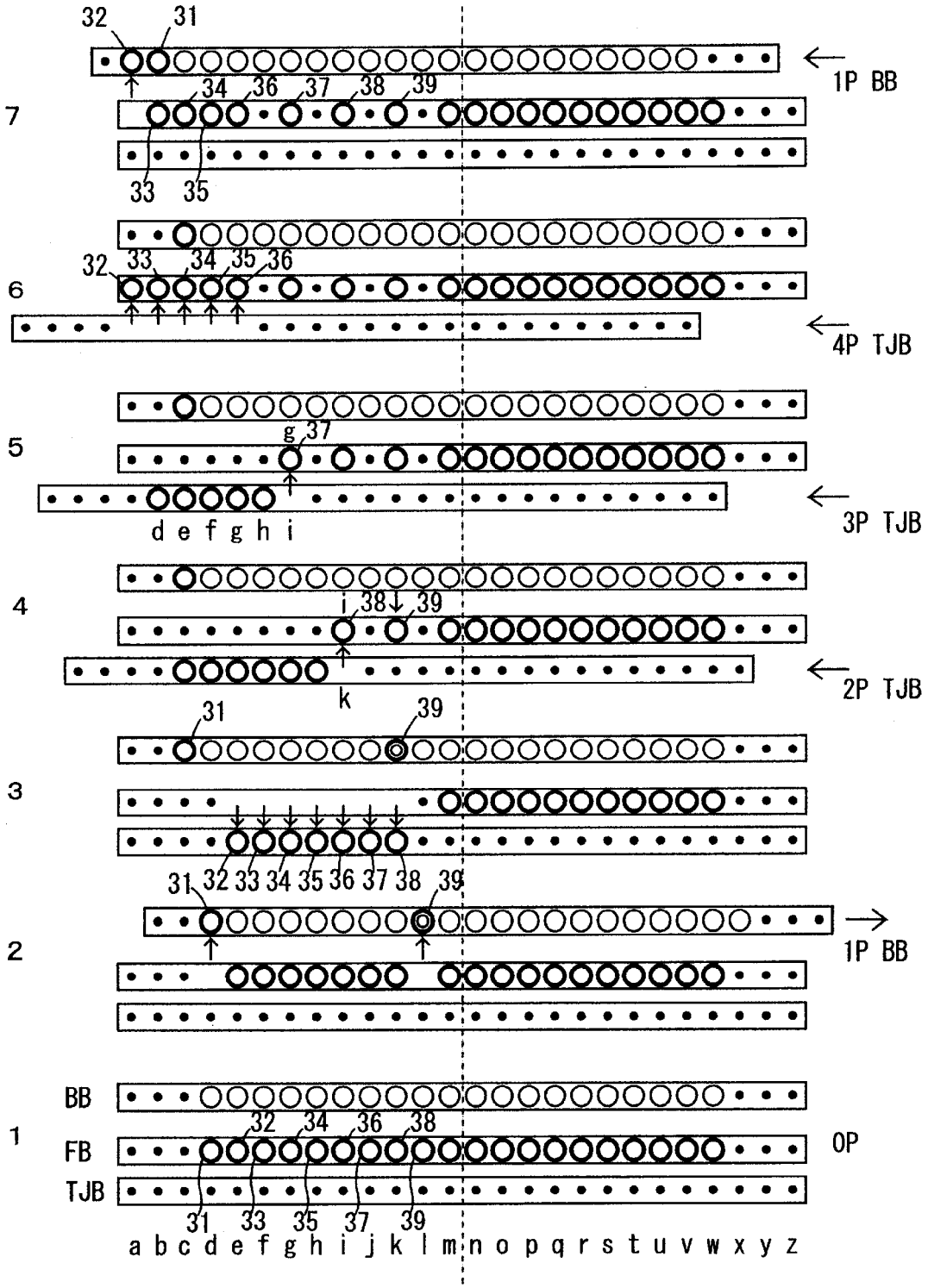
FIGS. 4–6 show knitting steps of the sweater of the embodiment.
Figure 5:
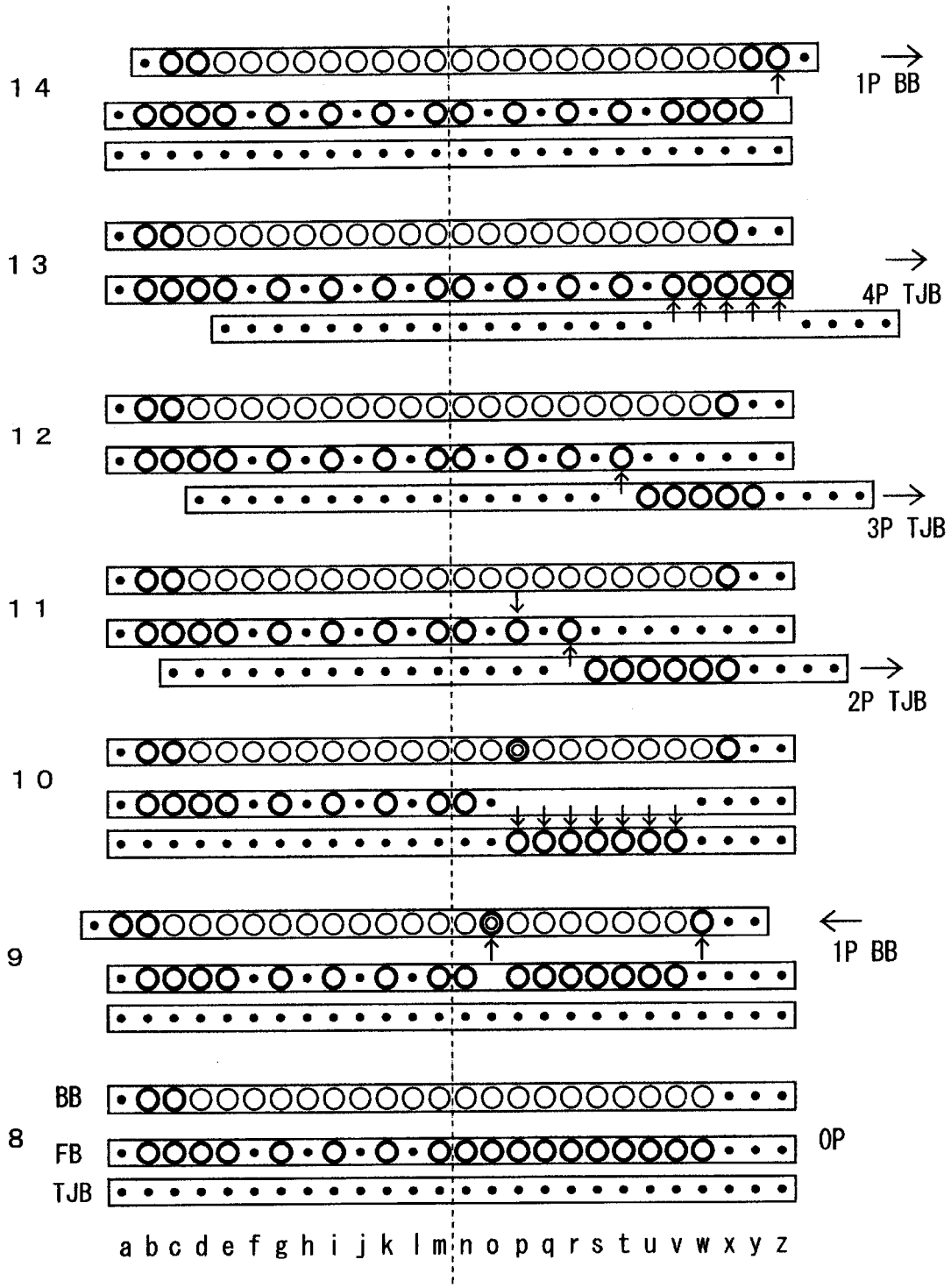
Figure 6:
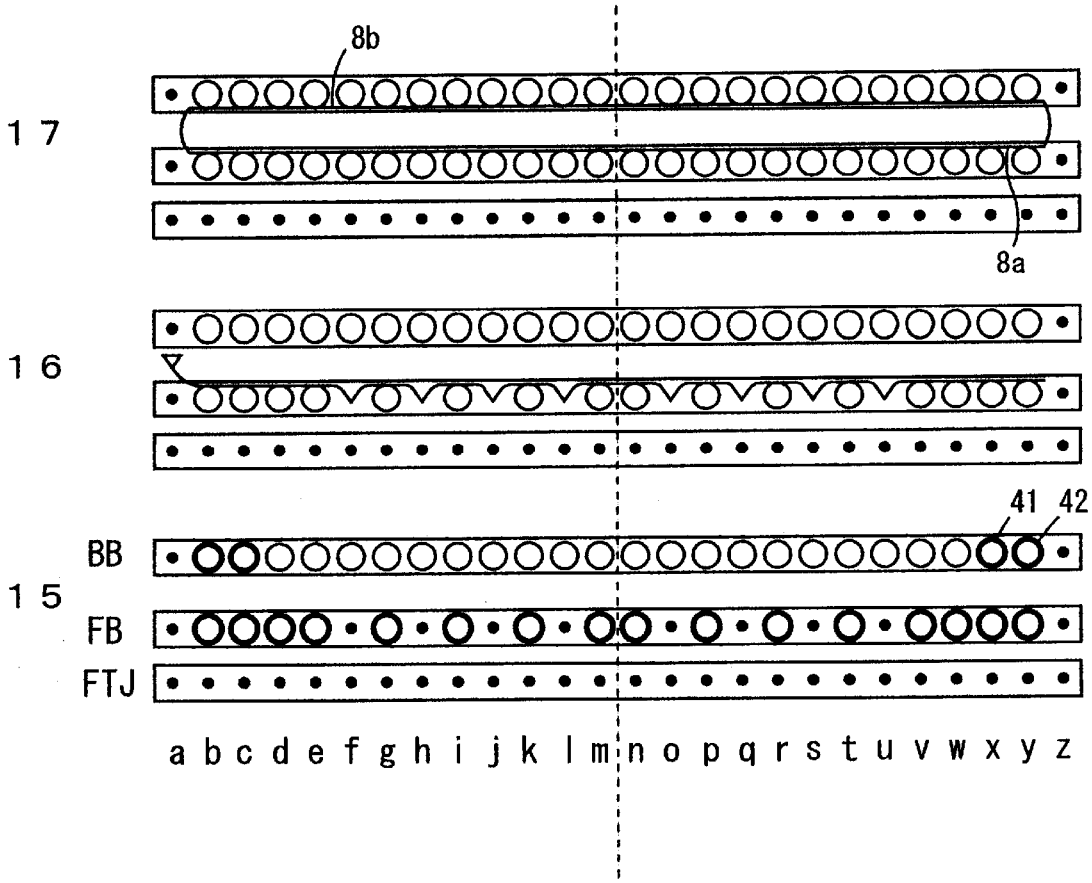

Next, the knitting of widening the knitting width of the neckline 10 after the formation of the neckline 10 and the knitting of the collar 8 continued thereto will be described with reference to FIGS. 4–6. The step 1 shows the state of the stitches being retained on the needle beds, which is presented when the joining of the sleeves 4, 14 and the bodies 2 is ended. The stitches of the front neckline 10*a* lying between two points B, b of the front body 2*a* are retained on the needles d–w of the front needle bed, and the stitches of the back neckline 10*b* on the line I–i of the back body 2*b* are retained on the needles d–w of the back needle bed. Bold circles in the diagrams represent the stitches of the front body. For convenience of explanation, a fewer number of stitches than the actual number of stitches is illustrated. At the point of time when the knitting for joining the sleeves 4, 14 and the body 2 is ended, the front neckline 10*a* and the back neckline 10*b* each have a knitting width of twenty wale. In the illustrated embodiment, four-wale increase of knitting width in each side of the front neckline 10 is taken as an example.

The knitting for widening the neckline is made by transference of the stitches of the front neckline 10*a*. During this knitting, the stitches of the back neckline 10*b* are held without transference. The steps 2–8 show the process of widening the left part of the neckline 10*a*, and the steps 9–15 show the process of the right part of the neckline 10*a*. The position where the back needle bed and the transfer jack bed are in the positional relationship shown in the step 1 is taken as a starting point for the racking of the same beds. First, in the step 2, after the back needle bed is racked rightwards a stitch, the stitch 39 retained on the needle "d" of the front needle bed is held on a tongue of a slider of a needle l of the back needle bed by using the holding technique and also the stitch 31 at the left end of the front neckline 10*a* is transferred to the needle "c" of the back needle bed. For a detailed explanation of the holding technique, reference can be made to the previously cited JP Laid-open (Unexamined) Patent Publication No. Hei 11 (1999)-43849 and accordingly the explanation of the holding technique is omitted here.

In the next step 3, the stitches 32–38 retained on the needles e–k of the front needle bed are transferred to the transfer jacks e–k. In the step 4, after the transfer jack bed is racked leftwards two stitches, the stitch 38 retained on the transfer jack "k" is transferred to the needle "i" of the front needle bed and also the stitch 39 held on the needle "k" of the back needle bed in the previous step 2 is transferred to the needle "k" of the front needle bed. In place of the holding technique used in the process previously mentioned, the transference of the stitch 39 may be afforded via the use of the transfer jack. This can produce the equivalent knitting even by latch needles.

In the step 5, after the transfer jack bed is further racked leftwards a stitch from the previous step (three stitches apart from the starting point), the stitch 37 retained on the transfer jack "i" is transferred to the needle "g" of the front needle bed. In the step 6, after the transfer jack bed is further racked leftwards a stitch (four stitches apart from the starting point), the stitches 32–36 retained on the transfer jacks d–h are transferred to the needles a–e of the front needle bed.

In the next step 7, after the back needle bed is racked leftwards a stitch, the stitch 32 as was transferred to the needle "a" of the front needle bed is transferred to the needle "b" of the back needle bed. The step 8 shows the state of the stitches of the neckline 10 being retained on the needle beds, which is presented when the back needle bed is returned to its starting racking point after the process of widening the left side of the neckline 10*a* is completed. The two stitches 31, 32 at the left end portion of the front neckline 10*a* are sequentially fed to the back needle bed from the stitch 31 situated at the end of the front neckline, so as to be situated next to the stitch at one side end of the back neckline lob. The stitches (33–39) to be shifted at the left side of the front neckline 10*a* are shifted leftwards from their preexistent positions to outside, with the gradually increasing distances of a stitch of distance, two stitches of distance, three stitches of distance and four stitches of distance from inside. As a result of this, the four empty needles f, h, j and l are put into the state of being inserted in the knitted fabric.

In the illustrated embodiment, the empty needles are inserted in between the stitches 36, 37, 38, 39, one in each space defined by the adjacent stitches. In the case where the neckline has a small number of stitches, as in the illustrated embodiment, the stitches may be shifted a stitch of distance, two stitches of distance, three stitches of distance and four stitches of distance every three stitches, for example, so that the empty needles may be inserted in the spaces thus formed, one in each of the spaces defined by those stitches. The empty needles as just required for the wale to be increased are inserted in between the stitches and the stitches as required to be shifted are split from each other to prevent the empty needles from being formed in a row. This enables the widening stitches to be smoothly formed in the later process. If the neckline does not have so many stitches to be split, then the empty needles may be formed in a row. In the illustrated embodiment, either side of the front neckline is increased four wale and the knitting width as was increased by feeding the stitches 31, 32 located at the end portion of the neckline to the back needle bed is divided into two by the front and back needle beds. If one side of the neckline is increased two wale, then only the stitch 32 at the side end thereof may be fed to the back needle bed. The number of stitches to be fed to the back needle bed depends on the extent to which the knitting width of the neckline is widened. With increase in the knitting width of the neckline to be widened, the number of stitches fed to the back needle bed increases.

The steps 9–15 show the knitting for widening the knitting width of the right side of the neckline 10*a*. In these steps, the same knitting process as the knitting process for the left side of the neckline 10*a* shown in the steps 2–8 is taken. The step 15 shows the state of the stitches of the neckline being retained after the front neckline 10*a* is widened. It will be seen from this that the neckline 10*a* is widened in knitting width four wale at each side thereof and two stitches at each end of the neckline are fed to the back needle bed. As a result of the stitches 31; 32, and 41; 42 at each side end portion of the front neckline 10*a* being fed to the back needle bed in this manner, the neckline can be increased in diameter, while keeping the stitches located at each side end portion of the front neckline in their retained state on the front and back needle beds, without being away from each other to a large extent.

The step 16 shows the step of forming the widening stitches on the empty needles f, h, j, l, o, q, s and u inserted in between the stitches when the collars 8*a*, 8*b* are knitted. While in the illustrated embodiment, the widening stitches are formed by a knitting yarn fed being simply hooked, the widening stitches may be formed by alternate widening-stitch techniques such as a split knit. Subsequently, the knitting yarn is fed to the needles of the front needle bed and then to the needles of the back needle bed alternately in a circulating manner, as shown in the step 17, to form the collars 8*a*, 8*b* having a desired length. In this step, since the stitches at each side end of each of the necklines retained on the front and back needle beds are situated close to each other, a cross-over yarn extending between the needle beds is prevented from being long drawn over the space between the both stitches, thus preventing the hand value of the fabric from being spoiled by the long drawn cross-over yarn. After the collar 8 is knitted into a tubular form in this manner, the knitted fabric is subjected to a known bind-off process for preventing loosening of stitches and the like and then is slipped off from the needles. The knitting of the sweater is ended with this.

According to the present invention, the knitting process for widening the neckline 10*a* is provided as a separate process after the front and back bodies are joined at the shoulder, as mentioned above. This can make it possible to ignore the issue that consideration must be taken of the horizontal and vertical positions of the parts of the fabric, such as the bodies and the sleeves, on the needle beds, as well as of the way how those parts are integrally knitted, while forming the neckline in the front body. In addition, this can provide the advantage of producing the knitting program for a variety of knitwear in a relatively easy and simple way, regardless of types of knitwear, a vest or a sweater, or types of sleeves, a raglan sleeve type or set-in type. Also, even when the flat knitting machine used owns a number of previously produced knitting programs, since the knitting program mentioned above can be simply added to those existing programs, modifications can be made easily.

A CAD system, such as "Apparel Total Design" (brand name) of the applicant, is used as hardware for designing the knitwear to be knitted. A designer designs knitwear by using this design system and inputs the data for knitting the sleeves and bodies into a tubular body to the design system. The flat knitting machine is driven under control of a computer built in the flat knitting machine. When the knitting program stored in a disc and the like is read and interpreted by the built-in computer, the mechanisms of the flat knitting machine are driven. The principal knitting processes including the knitting process for the neckline are stored in the form of subroutines in a computer aided knit design system for designing a knitted fabric. This type of knit design system includes the computer and output equipment so that the knitting programs can be written on the disc and the like. The knit design system stores knitting commands on the principal knitting points including the points on tubular knitting for providing seamless knit, on shaping knitting, such as widening stitch and narrowing stitch, and on binding off, in the form of subroutines. The subroutines associated with respective parts of the fabric designed by a user are properly combined with each other, so that the appropriate knitting commands are output. The knitting commands include the command for the flat knitting machine having the built-in computer to knit the fabric in accordance with the knitting commands. Thus, the flat knitting machine is driven under control of the built-in computer, while also the knitting commands stored in the disc and the like are read by the built-in computer and are interpreted by the knit design system, to reproduce a design picture of the fabric designed on the knit design system by the user. When it comes to the present invention, the number of stitches of the front neckline to be shifted or transferred and the stitches to be fed to the back needle bed are determined.

While the preferred embodiment of the present invention has been illustrated above, it is to be understood that the present invention is not limited thereto by may practically be embodied variously within the sprit and scope of the present invention. For example, even a general type of general-purpose two-bed flat knitting machine having no transfer jack or no slide needle can be used as the flat knitting machine used for the knitting of the present invention by using alternate needles, as previously mentioned. Likewise, the four-bed flat knitting machine may be used, via which the knitting of the present invention is afforded with every needle, without using the holding technique. Also, the front neckline may be increased in knitting width of four or more wale in each side thereof. The collar may be knitted to have the knitting structure of rib. The collar may be designed to have a turtle neck.

Capabilities of Exploitation in Industry

According to the present invention, the knitting process for widening the neckline is provided as a separate process after the front and back bodies are joined at the shoulder, as mentioned above. This can make it possible to ignore the issue that consideration must be taken of the horizontal and vertical positions of the parts of the fabric, such as the bodies and the sleeves, on the needle beds, as well as of the way how those parts are integrally knitted, while the neckline is formed in the front body. In addition, this can provide the advantage of producing the knitting program for a variety of knitwear in a relatively easy and simple way, regardless of types of knitwear, a vest or a sweater, or types of sleeves, a raglan sleeve type or set-in type. Also, even when the flat knitting machine used owns a number of previously produced knitting programs, since the knitting program mentioned above can be simply added to those existing programs, modifications can be made easily.

What is claimed is:

1. A method of knitting knitwear, comprising a front part of fabric having at least a front body and a back part of fabric having at least a back body by using a flat knitting machine comprising at least a pair of front and back needle beds, which are extended laterally and confront each other in back and front and at least either of which can be racked laterally to transfer stitches between the needles beds, the method comprising the step that the front part of fabric and the back part of fabric are knitted from their bottom hems to shoulders such that the front part of the fabric is associated with the first needle bed and the back part of the fabric is associated with the second needle bed, so that the front part of the fabric and the back part of the fabric are joined at both knitting-widthwise ends, so as to be knitted in the form of a tubular body; the step that during this process, the front body is knitted to be formed into a right front body and a left front body from a front neckline forming portion and also a flechage knitting that the stitches around a margin of the front neckline are sequentially slipped from the knitting to be put into inoperative positions is repeated a predetermined number of times, so as to form the neckline having a front drop in the front body; and the step that the front part of the fabric and the back part of the fabric are joined to each other at the shoulders, except at the front neckline and a back neckline, so that the knitwear is knitted into a seamless knit, the method further comprising the step that stitches at a right side of the front neckline and stitches at a left side of the front neckline, retained on the first needle bed, are shifted from inside to outside, with gradually increasing distances, so that those stitches are retained on the first needle bed, with empty needles inserted in the spaces between the stitches; the step that at least one of the shifted stitches at an outer side end portion of the right side of the front neckline and at least one of the shifted stitches at an outer side end portion of the left side of the front neckline are fed to the second needle bed so as to be situated next to the stitch at each side end of the back neckline retained on the second needle bed, whereby the stitches at each side end of each of the front and back necklines retained on the front and back needle beds are kept in positions close to each other, without being away from each other in a lateral direction to a large extent, as the neckline is increased in diameter, followed by formation of widening stitches on the empty needles and then knitting of a collar.

2. The method according to claim 1, wherein when there are a plurality of stitches to be fed to the second needle bed at the outer side end portion of the right side of the front neckline and at the outer side end portion of the left side of the front neckline, respectively, the plurality of stitches are sequentially fed to the second needle bed from the stitch situated at the side end of the front neckline.

3. A knit design system for producing a knitting process of a collar by using a flat knitting machine comprising at least a pair of front and back needle beds, which are extended laterally and confront each other in back and front and at least either of which can be racked laterally to transfer stitches between the needles beds, and a built-in computer, the knit design system comprising means for producing the following commands:

a: the command that stitches at a right side of a front neckline and stitches at a left side of the front neckline, retained on the first needle bed, are shifted from inside to outside, with gradually increasing distances, in such a sequence as to be first shifted a stitch and then shifted two stitches, so that those stitches are retained on the first needle bed, with empty needles inserted in the spaces between the stitches, and also at least one of the shifted stitches at an outer side end portion of the right side of the front neckline and at least one of the shifted stitches at an outer side end portion of the left side of the front neckline are fed to the second needle bed so as to be situated next to the stitch at each side end of a back neckline retained on the second needle bed;

b: the command that subsequent to the knitting process mentioned above, widening stitches are formed on the empty needles; and c: the command that subsequently, a collar is knitted.

4. The method of claim 1, wherein said knitwear is a sweater.

5. The method of claim 1, wherein said knitwear is a vest.

* * * * *